US007721464B2

(12) United States Patent
Hada et al.

(10) Patent No.: US 7,721,464 B2
(45) Date of Patent: May 25, 2010

(54) SYSTEM AND PROCESS FOR THROUGHDRYING TISSUE PRODUCTS

(75) Inventors: Frank S. Hada, Appleton, WI (US); Michael Alan Hermans, Neenah, WI (US); Ronald F. Gropp, St. Catharines (CA)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 847 days.

(21) Appl. No.: 10/662,139

(22) Filed: Sep. 12, 2003

(65) Prior Publication Data

US 2005/0072543 A1 Apr. 7, 2005

(51) Int. Cl.
*F26B 3/00* (2006.01)

(52) U.S. Cl. ..... 34/452; 162/307

(58) Field of Classification Search ..... 162/115, 162/359.1, 307, 205, 206; 34/443, 444, 448, 34/454, 452

See application file for complete search history.

(56) References Cited

U.S. PATENT DOCUMENTS 3,432,936 A 3/1969 Cole et al.
3,739,491 A 6/1973 Creapo et al.
3,807,059 A 4/1974 Lopata
3,891,500 A * 6/1975 Kankaanpaa ..... 162/274
4,036,684 A 7/1977 Schmitt et al.
4,072,557 A 2/1978 Schiel
4,124,942 A 11/1978 Ohls et al.
4,194,947 A 3/1980 Huostila et al.
4,238,284 A 12/1980 Huostila et al.
4,247,990 A 2/1981 Ohls et al.
4,481,722 A 11/1984 Guy et al.
4,606,137 A 8/1986 Whipple
4,785,759 A 11/1988 Motoyama et al.
4,876,803 A 10/1989 Wedel (Continued)

FOREIGN PATENT DOCUMENTS

EP 0984097 A2 3/2000

(Continued)

OTHER PUBLICATIONS

PCT Search Report and Written Opinion for PCT/US2004/004063, Sep. 1, 2004.

(Continued)

*Primary Examiner*—Kenneth B Rinehart
(74) *Attorney, Agent, or Firm*—Dority & Manning, P.A.

(57) ABSTRACT

A system and process for producing tissue webs is disclosed. The tissue webs are formed from an aqueous suspension of fibers and dried using a through-air dryer. During formation of the web, the web is transferred from a transfer fabric to a throughdrying fabric and then conveyed around a drying cylinder of a through-air dryer. In accordance with the present invention, a pressurized roll emits a gaseous stream through a pressurized zone that pushes and transfers a wet web from a transfer fabric to the throughdrying fabric. The amount of pressure used during the transfer can vary depending upon the particular application and may be used to control the bulk of the web. By using a pressurized transfer roll, the amount the throughdrying fabric is wrapped around the drying cylinder of the through-air dryer can be maximized for increasing the efficiency of the system and the process.

33 Claims, 4 Drawing Sheets

U.S. PATENT DOCUMENTS

| | | | |
|---|---|---|---|
| 4,905,380 | A | 3/1990 | Eskelinen et al. |
| 5,020,241 | A | 6/1991 | Fleissner |
| 5,068,980 | A | 12/1991 | Müller |
| 5,241,760 | A | 9/1993 | Wedel |
| 5,477,624 | A | 12/1995 | Haessner et al. |
| 5,515,619 | A | 5/1996 | Kahl et al. |
| 5,569,359 | A | 10/1996 | Joiner |
| 5,575,084 | A | 11/1996 | Vuorinen |
| 5,579,589 | A | 12/1996 | Oechsle et al. |
| 5,609,728 | A | 3/1997 | Durden |
| 5,709,775 | A | 1/1998 | Trokhan et al. |
| 5,722,180 | A | 3/1998 | Joiner |
| 5,725,734 | A | 3/1998 | Herman et al. |
| 5,766,418 | A | 6/1998 | Prough |
| 5,887,358 | A | 3/1999 | Bischel et al. |
| 5,933,979 | A | 8/1999 | Wedel |
| 6,032,385 | A | 3/2000 | Bischel et al. |
| 6,083,346 | A | 7/2000 | Hermans et al. |
| 6,093,284 | A | 7/2000 | Hada et al. |
| 6,143,135 | A | 11/2000 | Hada et al. |
| 6,149,767 | A | 11/2000 | Hermans et al. |
| 6,199,296 | B1 | 3/2001 | Jewitt |
| 6,228,216 | B1 | 5/2001 | Lindsay et al. |
| 6,228,220 | B1 | 5/2001 | Hada et al. |
| 6,306,257 | B1 | 10/2001 | Hada et al. |
| 6,331,230 | B1 | 12/2001 | Hermans et al. |
| 6,398,916 | B1 | 6/2002 | Klerelid |
| 6,447,641 | B1 | 9/2002 | Wolkowicz et al. |
| 6,454,904 | B1 | 9/2002 | Hermans et al. |
| 6,551,461 | B2 | 4/2003 | Leitner et al. |

FOREIGN PATENT DOCUMENTS

| | | |
|---|---|---|
| EP | 0984097 A3 | 3/2000 |

OTHER PUBLICATIONS

Abstract of WO90/12151, Oct. 18, 1990.

* cited by examiner

SYSTEM AND PROCESS FOR THROUGHDRYING TISSUE PRODUCTS

BACKGROUND OF THE INVENTION

In the manufacture of high-bulk tissue products, such as facial tissue, bath tissue, paper towels, and the like, it is common to use one or more throughdryers for partially drying the web or to bring the tissue web to a final dryness or near-final dryness. Generally speaking, throughdryers typically include a rotating cylinder having an upper deck that supports a drying fabric which, in turn, supports the web being dried. In one embodiment, heated air is provided by a hood above the drying cylinder and is passed through the web while the web is supported by the drying fabric. In an alternative embodiment, heated air is fed to the drying cylinder, passed through a web traveling around the drying cylinder, and is then fed to and collected in a hood.

When incorporated into a papermaking system, throughdryers offer many and various benefits and advantages. For example, throughdryers are capable of drying tissue webs without compressing the webs. Thus, moisture is removed from the webs, without the webs losing a substantial amount of bulk or caliper. In fact, throughdryers, in some applications, may even serve to increase the bulk of a web. Throughdryers are also known to contribute to various other important properties and characteristics of the webs.

The use of throughdryers, however, can be expensive. For instance, in addition to the capital costs associated with the equipment, throughdryers have relatively high-energy requirements. Therefore, a need currently exists for a system and process for reducing the energy costs associated with throughdryers, while still retaining all the benefits and advantages to using throughdryers.

SUMMARY OF THE INVENTION

In general, the present invention is directed to a system and process for through-air drying paper webs, namely tissue webs. According to the process and system of the present invention, the tissue web is formed from an aqueous slurry containing pulp fibers. The aqueous slurry is deposited onto a permeable forming fabric in creating the web. The forming fabric or a transfer fabric conveys the web to a through-air dryer. The through-air dryer comprises a hood surrounding a drying cylinder. The through-air dryer is configured to convey a hot gaseous stream through a wet paper web traveling in between the drying cylinder and the hood. For instance, the hot gaseous stream may travel from the drying cylinder into the hood or may travel from the hood into the drying cylinder.

A throughdrying fabric is wrapped around a drying cylinder of the through-air dryer. The throughdrying fabric, for instance, can form an endless loop around the cylinder.

In accordance with the present invention, a transfer roll is positioned outside the endless loop of the throughdrying fabric and is configured to facilitate transfer of the tissue web from the transfer fabric to the throughdrying fabric. For example, the transfer fabric and the throughdrying fabric may be wrapped around the transfer roll in an overlapping relationship. The transfer roll may include a pressurized zone configured to emit a gaseous stream for facilitating transfer of the tissue web from the transfer fabric to the throughdrying fabric.

In the past, instead of using a transfer roll having a pressurized zone, a vacuum roll positioned on the inside of the endless loop of the throughdrying fabric was used. The present inventors, however, have discovered that various advantages and benefits may be obtained when using a pressurized transfer roll instead of a vacuum transfer roll.

For example, when using a pressurized transfer roll, as described above, the transfer roll is positioned on the outside of the endless loop of the throughdrying fabric. Because the transfer roll is positioned on the outside of the endless loop, the wrap of the throughdrying fabric around the drying cylinder can be increased. Since the drying capability of a throughdryer is proportional to the amount of wrap of the throughdrying fabric around the cylinder, an increase in wrap can significantly increase the throughput of the through-air dryer. Further, a pressurized transfer roll typically requires less energy than a vacuum roll further increasing the overall efficiency of the papermaking system.

Because the transfer roll of the present invention is positioned outside of the endless loop of the throughdrying fabric, the throughdrying fabric may be wrapped around the drying cylinder at least 270°, at least 285°, or preferably at least about 300°. In one particular embodiment, the throughdrying fabric can be wrapped around the drying cylinder according to the present invention in an amount of at least about 330°.

As described above, in one embodiment, the transfer roll of the present invention includes a pressurized zone configured to emit a gaseous stream. For instance, the gaseous stream can be air. The air can be emitted at a pressure of at least about 1 inch Hg such as from about 1 inch Hg to about 60 inches Hg. Since pressure rather than vacuum is used to transfer the web, the force can exceed an atmosphere, which can be particularly advantageous when transferring a relatively heavy web.

In one embodiment, the transfer fabric can be wrapped around and placed adjacent to the transfer roll. A tissue web carried on the transfer roll is sandwiched between the transfer fabric and the throughdrying fabric along the transfer roll. The throughdrying fabric overlaps the transfer fabric along the entire length of the pressurized zone located on the transfer roll. At the end of the pressurized zone, however, the throughdrying fabric separates from the transfer fabric and travels around the drying cylinder of the through-air dryer. Due to the gas being emitted through the pressurized zone on the transfer roll, the tissue web is transferred to the throughdrying fabric and fed through the through-air dryer.

In one embodiment of the present invention, the papermaking system is configured such that the tissue web never directly contacts any of the papermaking rolls around which the fabrics are wrapped. Should the tissue web contact one of the papermaking rolls, such as the transfer roll, pinholes and other defects may have a tendency to form in the web.

Another problem with "sheet-side" rolls is the tendency of fibers and chemicals to build up on the surface of the roll, which requires a shutdown of the equipment in order to clean the rolls periodically.

As described above, in addition to a system for making a tissue web, the present invention is also directed to a process for making a tissue web. The process can include the steps of forming a wet tissue web by depositing an aqueous suspension of papermaking fibers onto a forming fabric. The wet tissue web may be partially dewatered. The tissue web is conveyed from a transfer fabric to a throughdrying fabric. During the transfer, the tissue web is contacted by a fluid stream that pushes the web from the transfer fabric to the throughdrying fabric as the web is being conveyed in between the two fabrics around a transfer roll.

After the transfer, the tissue web is dried in a through-air dryer as the web is conveyed on the throughdrying fabric. The through-air dryer, for instance, may include a drying cylinder. The throughdrying fabric and the tissue web are wrapped around the drying cylinder at least about 300°, such as at least about 330°. After being dried, the web is then wound into a parent roll. In accordance with the present invention, the formed web can have a bulk of at least about 6 cc/g. The tissue web may be used to form various tissue products, such as bath tissue, facial tissue, paper towels, and the like.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

Figure 1:
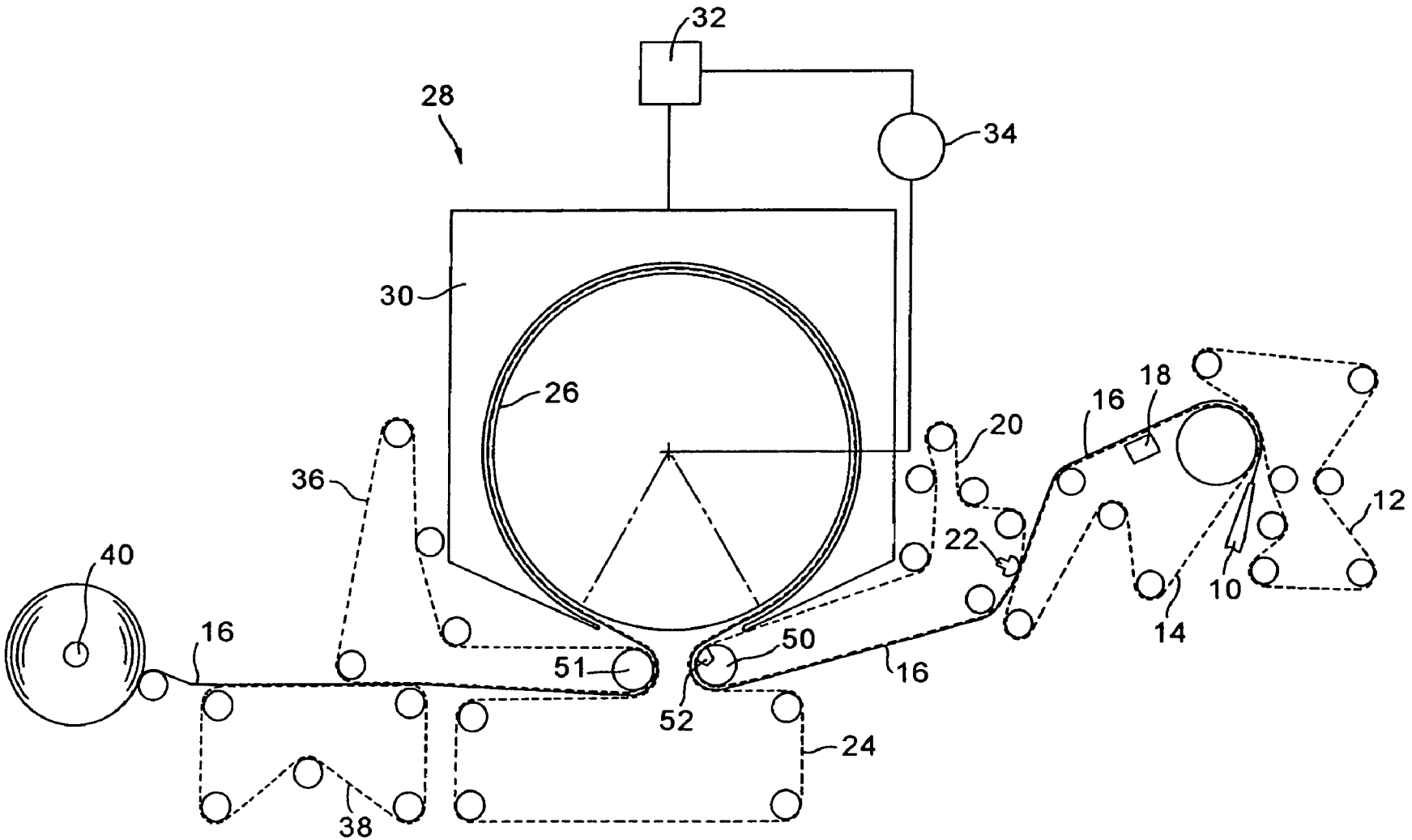
FIG. 1 is a side view of one embodiment of a papermaking system in accordance with the present invention.

Repeated use of reference characters in the present specification and drawings is intended to represent the same or analogous features or elements of the invention.

DETAILED DESCRIPTION OF THE PREFERRED EMBODIMENT

It is to be understood by one of ordinary skill in the art that the present discussion is a description of exemplary embodiments only, and is not intended as limiting the broader aspects of the present invention, which broader aspects are embodied in the exemplary constructions.

In general, the present invention is directed to an improved system and process for drying paper webs, particularly tissue webs. More particularly, in one embodiment, the throughput of a through-air dryer is improved according to the present invention by transferring a tissue web to a throughdrying fabric wrapped around the through-air dryer using a pressurized gas, such as air. For instance, a pressurized transfer roll may be used that emits a gaseous stream for pushing a tissue web from a transfer fabric to a throughdrying fabric. By using a pressurized transfer roll, the amount of wrap of the tissue web around the through-air dryer may be increased, which increases the drying capability of the dryer. For example, by increasing the wrap of the tissue web and the throughdrying fabric around the dryer, the potential output of the dryer is increased. By increasing the wrap, for instance, the speed of the dryer may be increased and/or the temperature of the dryer may be decreased.

For purposes of illustration, one embodiment of a papermaking process made in accordance with the present invention is shown in FIG. 1. As illustrated, the system includes a head box 10 which injects and deposits a stream of an aqueous suspension of papermaking fibers between a first forming fabric 12 and a second forming fabric 14. The forming fabric 14 serves to support and carry the newly-formed wet web 16 downstream in the process as the web is partially dewatered to a consistency of about 10 dry weight percent. Additional dewatering of the wet web 16 can be carried out, such as by vacuum suction, using one or more vacuum boxes 18. As shown, the vacuum box 18 is positioned below the forming fabric 14. The vacuum box 18 applies a suction force to the wet web thereby removing moisture from the web.

From the forming fabric 14, the wet web 16 is transferred to a transfer fabric 20. The transfer may be carried out using any suitable mechanism. As shown in FIG. 1, in this embodiment, the transfer of the web from the forming fabric 14 to the transfer fabric 20 is done with the assistance of a vacuum shoe 22.

In one embodiment, the web 16 may be transferred from the forming fabric 14 to the transfer fabric 20 while the transfer fabric 20 is traveling at a slower speed than the forming fabric 14. For example, the transfer fabric may be moving at a speed that is at least 5%, at least 8%, or at least 10% slower the speed of the forming fabric. This process is known as a "rush transfer" and may be used in order to impart increased machine direction stretch into the web 16.

From the transfer fabric 20, the tissue web 16 is transferred to a throughdrying fabric 24 and carried around a drying cylinder 26 of a through-air dryer generally 28. As shown, the through-air dryer 28 includes a hood 30. Hot air used to dry the tissue web 16 is created by a burner 32. More particularly, a fan 34 forces hot air created by the burner 32 into the hood 30. Hood 30 directs the hot air through the tissue web 16 carried on the throughdrying fabric 24. The hot air is drawn through the web and through the drying cylinder 26, which is perforated. At least a portion of the hot air is then re-circulated back to the burner 32 using the fan 34. In one embodiment, in order to avoid moisture build-up in the system, a portion of the spent heated air is vented, while a proportionate amount of fresh make-up air is fed to burner 32.

Although the embodiment in FIG. 1 shows hot air flowing from the hood 30 to the drying cylinder 26, it should be understood that the system of the present invention is equally applicable to through-air dryers where hot air flows from the drying cylinder 26 to the hood 30.

While supported by the throughdrying fabric 24, the tissue web 16 is dried to a final consistency of, for instance, about 94% or greater by the through-air dryer 28. The tissue web 16 is then transferred to a second transfer fabric 36. Transfer of the web 16 to the second transfer fabric 36 may be facilitated by a turning roll 51. The turning roll 51 may be, for instance, a vacuum roll that pulls the web onto the second transfer fabric 36. From the second transfer fabric 36, the dried tissue web 16 may be further supported by an optional carrier fabric 38 and transported to a reel 40. Once wound into a roll, the tissue web 16 may then be sent to a converting process for being calendered, embossed, cut and/or packaged as desired.

In the embodiment shown in FIG. 1, the system and process includes a single through-air dryer 28. It should be appreciated, however, that the system and process may include more than one through-air dryer in series. For example, in one embodiment, the system may include two through-air dryers positioned sequentially with respect to each other.

In accordance with the present invention, in order to transfer the tissue web 16 from the first transfer fabric 20 to the throughdrying fabric 24, as shown in FIG. 1, the system includes a pressurized transfer roll 50. As illustrated, the transfer roll 50 can include, for instance, a pressurized zone 52 that pushes the web 16 from the transfer fabric 20 to the throughdrying fabric 24. The transfer roll 50 may be configured so as to emit a pressurized fluid, such as air through the pressurized zone 52.

The gas that is emitted through the pressurized zone 52 can be at any suitable pressure that facilitates transfer of the web. For example, in one embodiment, a gas can be at a pressure of at least 1 inch of Hg, at least 2 inches of Hg, or in one embodiment, at least 4 inches of Hg. The pressure may range, for instance, from about 1 inch of Hg to about 60 inches Hg, such as from about 4 inches of Hg to about 25 inches of Hg. Since pressure rather than vacuum is used to transfer the web, the force can exceed an atmosphere which can be especially useful in transferring relatively heavy webs.

By using the pressurized roll 50 as shown in FIG. 1 in order to assist the transfer of the tissue web 16 from the transfer fabric 20 to the throughdrying fabric 24, various advantages and benefits are obtained. For example, by using a pressurized roll, the amount the throughdrying fabric 24 is wrapped around the drying cylinder 26 of the through-air dryer 28 may be increased, thereby increasing the throughput of the through-air dryer. For example, as shown in FIG. 1, by using a pressurized transfer roll, the transfer roll may be placed outside of an endless loop formed by the throughdrying fabric 24. When placed on the outside of the loop formed by the throughdrying fabric 24, the transfer roll 50 does not interfere with the fabric as it is wrapped around the drying cylinder 26.

For instance, as shown in FIG. 1, the transfer roll 50 is positioned opposite the turning roll 51. The turning roll 51 is also positioned outside of the endless loop formed by the throughdrying fabric 24. The turning roll 51 in combination with the transfer roll 50 determines the amount the throughdrying fabric is wrapped around the drying cylinder 26, which is referred to a "wrap angle". By being placed on the outside of the endless loop formed by the throughdrying fabric 24, the wrap angle may be increased.

In the past, instead of using a pressurized transfer roll, a vacuum roll was used. For example, referring to FIG. 3, one embodiment of a prior art throughdryer configuration is shown. As illustrated, a tissue web 116 is conveyed on a first transfer fabric 120 around a guide roll 144 and to a vacuum roll 142. A throughdrying fabric 124 is also wrapped around the guide roll 144 and extends along the surface of the vacuum roll 142. At the vacuum roll 142, the tissue web 116 is transferred from the transfer fabric 120 to the throughdrying fabric 124. To assist or facilitate transfer, the vacuum roll 142 creates a suction force against the throughdrying fabric for pulling the web against the throughdrying fabric. Once transferred to the throughdrying fabric 124, the tissue web 116 is then carried around a drying cylinder 126 of a through-air dryer 128. After the through-air dryer 128, the web 116 is then transferred to a second transfer fabric 136.

Figure 3:
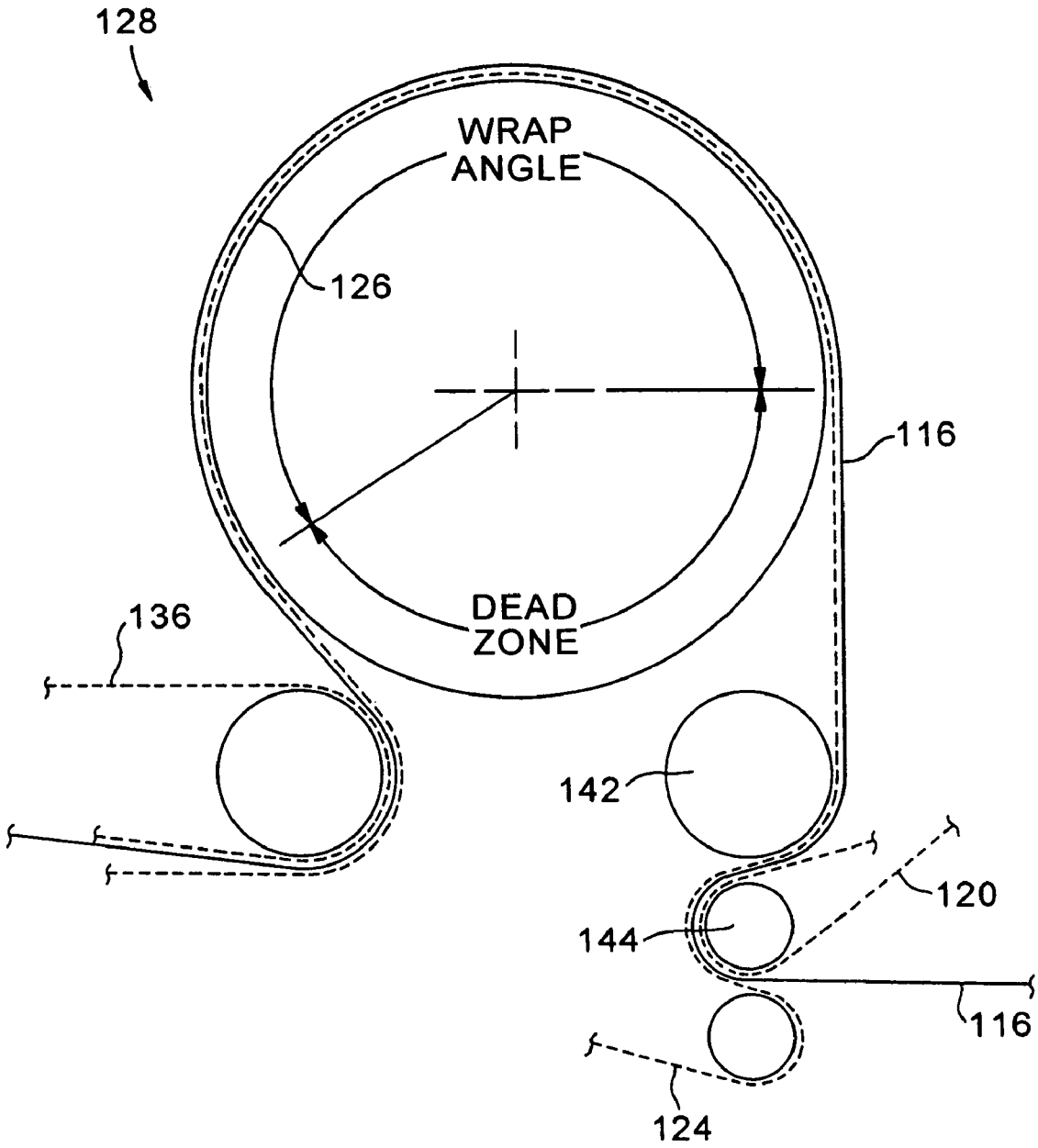
FIG. 3 PRIOR ART
FIG. 3 is a side view of a prior art through-air dryer configuration; and, FIG. 4 is a perspective view with cutaway portions of a positive pressure transfer roll configured in accordance with the present invention.

As shown in FIG. 3, the vacuum roll 142 is positioned on the inside of the throughdrying fabric 124. By being placed on the inside of the throughdrying fabric, the vacuum roll 142 interferes with the ability of the throughdrying fabric 124 to be wrapped around the drying cylinder 126. As such, a significant amount of dead zone is created around the drying cylinder 126 where the tissue web 116 is not being dried. As used herein, the "dead zone" refers to the portion of the outer circumference of the drying cylinder that is not included in the travel path of a tissue web being dried. This dead zone decreases the efficiency of the through-air dryer 128 and leads to increased energy costs.

Figure 2:
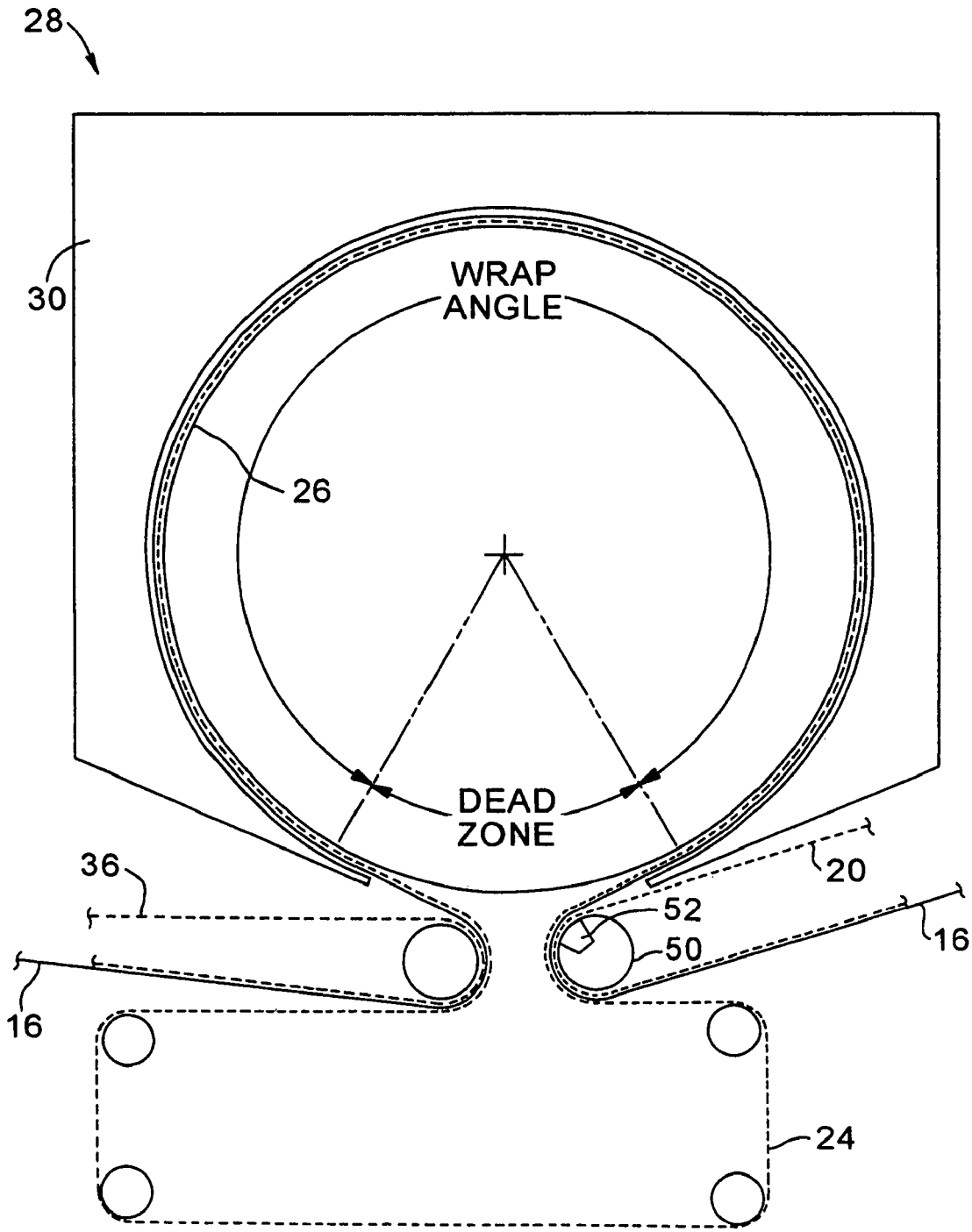
FIG. 2 is a side view of one embodiment of a through-air dryer configured according to the present invention.

As shown in FIG. 1 and particularly in FIG. 2, according to the present invention, the pressurized roll 50 is used which allows for greater wrap of the throughdrying fabric 24 around the drying cylinder 26. For example, the dead zone around the drying cylinder 26 in FIG. 2 is much smaller than the dead zone shown in FIG. 3. In fact, when using a pressurized roll as shown in FIG. 2, the wrap of the throughdrying fabric 24 around the drying cylinder 26 can be at least 270°, at least 280°, at least 290°, and even greater than 300°. For example, in one embodiment, the wrap of the throughdrying fabric around the drying cylinder can be greater than about 330°.

As described above, increasing the wrap of the throughdrying fabric around the drying cylinder increases the output capability of the through-air dryer 28. For instance, not only is less energy needed to dry a tissue web, but tissue webs are also dried at a faster rate. In this regard, when using the configuration of the present invention, the speed of the throughdrying fabric 24 around the drying cylinder may be increased while still drying the webs to the same extent. Instead of or in addition to increasing the speed of the throughdrying fabric 24, in other embodiments, the size of the through-air dryer itself may be reduced. Further, in still another embodiment, the through-air dryer may operate at a lower temperature.

In addition to providing the capability of wrapping the throughdrying fabric to a greater extent around the drying cylinder, the system of the present invention also offers other benefits and advantages in comparison to the prior art configuration shown in FIG. 3. For example, the use of the pressurized roll 50 is also more energy efficient than the use of a vacuum roll 142 as shown in FIG. 3. Vacuum rolls as shown in FIG. 3, for instance, require high air flows and require a greater amount of energy to create the same pressure differential as a pressurized roll, especially at relatively high pressures.

Figure 4:
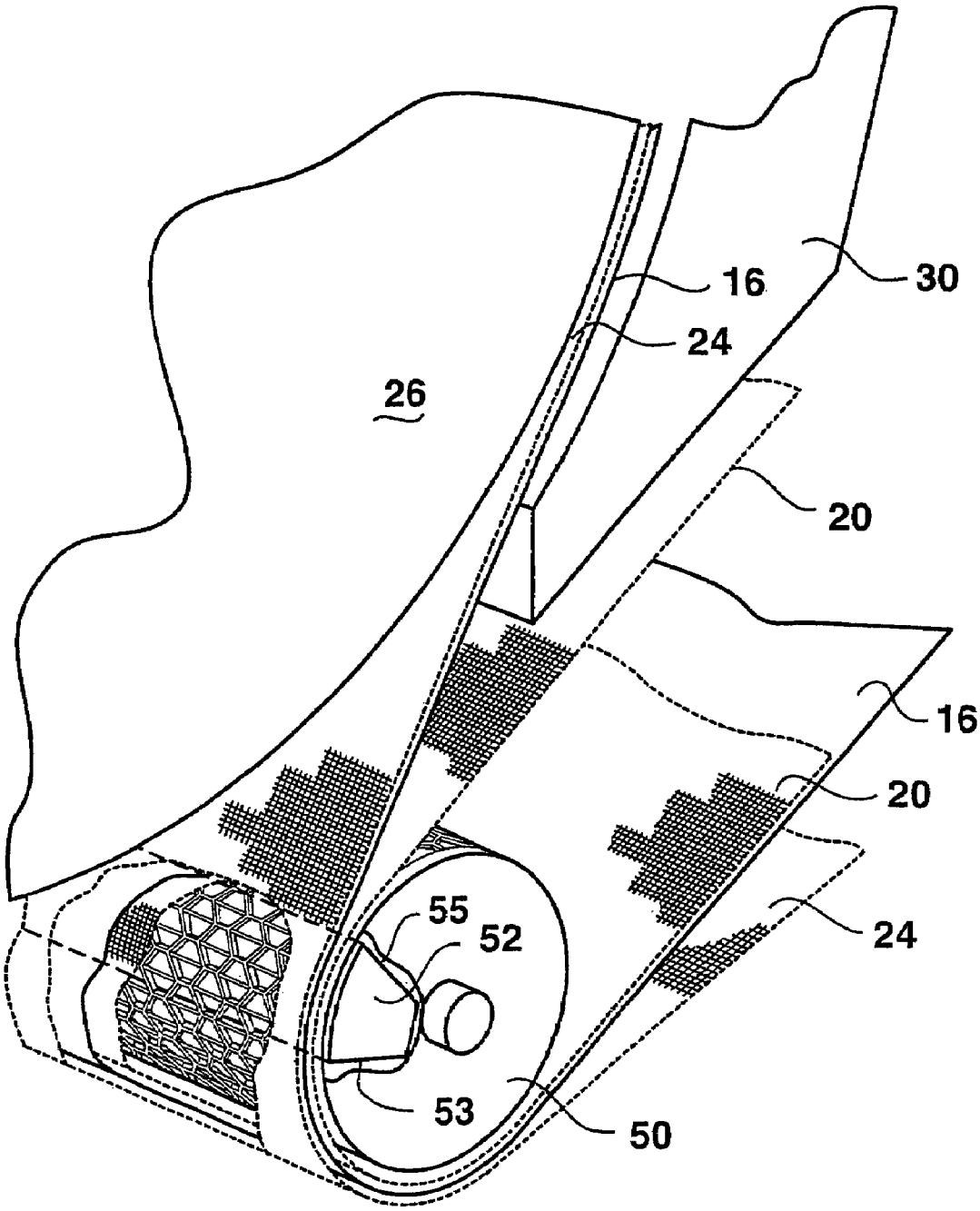

As shown in FIG. 2 and FIG. 4, one particular embodiment of a system utilizing the pressurized roll 50 in accordance with the present invention is shown. As illustrated, in this embodiment, the first transfer fabric 20 is wrapped around the transfer roll 50 adjacent to an exterior surface of the roll. The throughdrying fabric 24 overlaps the transfer fabric 20 and also wraps around the transfer roll 50. A tissue web 16 is positioned in between the transfer fabric 20 and the throughdrying fabric 24 along the transfer roll 50.

In this embodiment, the transfer roll 50 includes a pressurized zone 52 which can be, for instance, an air knife. For most applications, the throughdrying fabric 24 should be wrapped around the transfer roll 50 so as to completely cover the pressurized zone 52. At approximately the end of the pressurized zone 52, however, the throughdrying fabric 24 may diverge from the transfer fabric 20. Due to the gas that is emitted from the pressurized roll 50, the web 16 remains on the outside surface of the throughdrying fabric 24 as the fabrics diverge and separate.

For instance, as shown in FIG. 4, the pressurized zone 52 includes a first, upstream end 53 and a second, downstream end 55. The transfer fabric 20, the tissue web 16, and the throughdrying fabric 24 all extend from the first end 53 to the second end 55 of the pressurized zone 52. At the second, downstream end 55 of the pressurized zone 52, however, the throughdrying fabric 24 diverges from the transfer fabric 20. Due to the pressurized zone 52, the tissue web 16 remains on the throughdrying fabric when the fabrics diverge.

As also shown in FIG. 4, in this embodiment, the transfer roll 50 is perforated to allow a gas to flow through the pressurized zone 50. For instance, in the embodiment shown in FIG. 4, the transfer roll 50 has a honeycomb-like structure. In this manner, the transfer roll may have an open area of at least about 50%, such as at least about 75%. In one particular embodiment, for instance, the transfer roll may have an open area of greater than about 80%.

The holes that are formed into the transfer roll 50 may vary depending upon the particular application. For example, instead of the hexagon-like shaped openings shown in FIG. 4, the holes may have any suitable shape, such as in the shape of circles, ellipses, rectangles, and the like. The openings may have an effective diameter of from about 0.25 inches to about 0.5 inches.

The length or arc of the pressurized zone 52 of the transfer roll 50 may vary depending upon the particular application. For example, the arc of the pressurized zone 52 may vary from about 5° to about 150° and particularly from about 10° to about 20°.

In one embodiment, the throughdrying fabric 24 may comprise a relatively coarse fabric. In this embodiment, the tissue 16 may be pressed against the throughdrying fabric 24 by the transfer roll 50 with a force sufficient for the web to mold against the throughdrying fabric.

As shown in FIGS. 1 and 2, in one embodiment of the present invention, the tissue web 16 is conveyed from the forming fabrics to the reel without ever contacting any of the papermaking rolls. Instead, the tissue web is conveyed on a fabric throughout the entire process. In some applications, it is believed that this configuration provides various advantages. For example, contact with a papermaking roll or shoe may create pinholes in the web or otherwise damage the web. When the tissue web contacts any of the papermaking rolls, the rolls also have a tendency to collect papermaking fibers and chemicals applied to the web which requires the process to be shut down periodically in order to clean the rolls. According to the present invention, however, the tissue web may be conveyed only on the fabrics while still achieving all of the above described and discussed advantages and benefits to using the pressurized roll 50.

The fabrics depicted in the drawings may be woven fabrics, screens, or any other suitable porous conveyor. Of particular advantage, in one embodiment, one or more of the fabrics, such as the transfer fabric 20, may comprise a felt. Felts can have a relatively low permeability in relation to other porous fabrics. Since positive pressure is used to transfer the web in the present invention, however, the pressure being emitted by the transfer roll 50 can be increased sufficient to transfer a web from a felt to another fabric. By using positive pressure, greater pressure differentials can be created as opposed to when using vacuum devices.

As described above, the present invention is particularly well suited for use with through-air dryers as shown in FIGS. 1, 2, and 4. It should be understood, however, that the principles of the present invention may be applied to any drying cylinder in which a wet web is conveyed around the cylinder on a dryer fabric. In this regard, the use of a transfer roll as described above may also be used in conjunction with a heated drying cylinder, such as a Yankee dryer. In many applications, tissue webs are adhered directly to the surface of the Yankee dryer. However, in some applications dryer fabrics are used to convey a web around a Yankee dryer. Under these circumstances, incorporation of a positive pressure transfer roll as described above into the drying system may provide various benefits and advantages.

These and other modifications and variations to the present invention may be practiced by those of ordinary skill in the art, without departing from the spirit and scope of the present invention. In addition, it should be understood that aspects of the various embodiments may be interchanged both in whole or in part. Furthermore, those of ordinary skill in the art will appreciate that the foregoing description is by way of example only, and is not intended to limit the invention.

What is claimed is:

1. A system for through-air drying paper webs comprising:

a first fabric for conveying a paper web;

a through-air dryer comprising a hood surrounding a drying cylinder, the through-air dryer being configured to convey a hot gaseous stream through a paper web traveling over the drying cylinder;

a throughdrying fabric being wrapped around the drying cylinder of the through-air dryer, the throughdrying fabric forming an endless loop; and a transfer roll positioned outside the endless loop of the throughdrying fabric, the first fabric and the throughdrying fabric being wrapped around the transfer roll in an overlapping relationship, the transfer roll including a pressurized zone configured to emit a gaseous stream for facilitating transfer of a paper web from the first fabric to the throughdrying fabric, adjacent to the transfer roll, the pressurized zone located on the transfer roll being configured to emit the gaseous stream at a pressure of from about 4 inches Hg to about 60 inches Hg.

2. A system as defined in claim 1, wherein the throughdrying fabric is wrapped around the drying cylinder at least 27°.

3. A system as defined in claim 1, wherein the throughdrying fabric is wrapped around the drying cylinder at least 285°.

4. A system as defined in claim 1, wherein the throughdrying fabric is wrapped around the drying cylinder at least 300°.

5. A system as defined in claim 1, wherein the throughdrying fabric is wrapped around the drying cylinder at least 330°.

6. A system as defined in claim 1, wherein the transfer roll comprises a rotatable roll.

7. A system as defined in claim 1, further comprising a turning roll located downstream of the transfer roll along the through-air dryer, the throughdrying fabric being wrapped around the turning roll as the fabric leaves the drying cylinder of the through-air dryer, the turning roll in combination with the transfer roll determining the amount the throughdrying fabric is wrapped around the drying cylinder of the through-air dryer.

8. A system as defined in claim 7, further comprising a second fabric wrapped around the turning roll in an overlapping relationship with the throughdrying fabric, wherein a paper web is conveyed through the through-air dryer by the throughdrying fabric, is fed in between the throughdrying fabric and the second fabric along the turning roll, and is then transferred to the second fabric.

9. A system as defined in claim 7, wherein the turning roll is positioned outside the endless loop of the throughdrying fabric.

10. A system as defined in claim 9, wherein the turning roll comprises a vacuum roll.

11. A system as defined in claim 1, wherein the pressurized zone has an upstream end, a downstream end, and a length and wherein the throughdrying fabric is wrapped around the transfer roll over the entire length of the pressurized zone, the throughdrying fabric separating from the first fabric at about the downstream end of the pressurized zone.

12. A system as defined in claim 1, wherein the hot gaseous stream travels from the drying cylinder into the hood.

13. A system as defined in claim 1, wherein the hot gaseous stream travels from the hood into the drying cylinder.

14. A system as defined in claim 1, wherein the system is configured such that a paper web does not directly contact any rolls around which the first fabric or the throughdrying fabric are wrapped.

15. A system as defined in claim 8, wherein the system is configured such that a paper web does not directly contact any rolls around which the first fabric, the throughdrying fabric, or the second fabric are wrapped.

16. A system as defined in claim 1, further comprising a forming fabric for receiving an aqueous suspension of paper making fibers, the forming fabric configured to partially dewater the deposited paper making fibers prior to transfer to the first fabric.

17. A system as defined in claim 16, further comprising a vacuum box positioned adjacent the forming fabric.

18. A system as defined in claim 16, further comprising a vacuum shoe for facilitating transfer of a paper web from the forming fabric to the first fabric.

19. A system as defined in claim 16, wherein the first fabric is configured to move at a speed that is at least 5% slower than the speed of the forming fabric.

20. A system as defined in claim 16, wherein the first fabric is configured to move at a speed that is at least 8% slower than the speed of the forming fabric.

21. A system as defined in claim 16, wherein the first fabric is configured to move at a speed that is at least 10% slower than the speed of the forming fabric.

22. A system as defined in claim 1, further comprising a second through-air dryer.

23. A system as defined in claim 1, wherein the transfer roll is perforated.

24. A system as defined in claim 23, wherein the transfer roll comprises a honeycomb-like structure.

25. A system as defined in claim 23, wherein the transfer roll has an open area of at least about 50%.

26. A system as defined in claim 23, wherein the transfer roll has an open area of at least about 75%.

27. A system as defined in claim 23, wherein the transfer roll has an open area of at least about 80%.

28. A system as defined in claim 23, wherein the perforations have an effective diameter of from about 0.25 inches to about 0.5 inches.

29. A system as defined in claim 1, wherein the pressurized zone defines an arc from about 5° to about 150°.

30. A system as defined in claim 1, wherein the pressurized zone defines an arc from about 10° to about 20°.

31. A system as defined in claim 1, wherein the first fabric comprises a felt.

32. A tissue making system incorporating the through-air dyer system of claim 1.

33. A tissue making system as defined in claim 32, comprising a head box configured to contain an aqueous suspension of papermaking fibers and for depositing the aqueous suspension onto a forming fabric.

* * * * *